US010243308B2

(12) United States Patent
Beischer et al.

(10) Patent No.: US 10,243,308 B2
(45) Date of Patent: Mar. 26, 2019

(54) PLUG-IN SYSTEM AND APPARATUS COMPRISING A PLUG-IN SYSTEM

(71) Applicant: HARTING ELECTRIC GMBH & CO. KG, Espelkamp (DE)

(72) Inventors: Thomas Beischer, Espelkamp (DE); Uwe Sundermeier, Espelkamp (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 15/757,960

(22) PCT Filed: Sep. 6, 2016

(86) PCT No.: PCT/DE2016/100411

§ 371 (c)(1),
(2) Date: Mar. 6, 2018

(87) PCT Pub. No.: WO2017/041788

PCT Pub. Date: Mar. 16, 2017

(65) Prior Publication Data

US 2018/0254588 A1 Sep. 6, 2018

(30) Foreign Application Priority Data

Sep. 9, 2015 (DE) ..... 10 2015 011 494

(51) Int. Cl.
*H01R 24/00* (2011.01)
*H01R 13/514* (2006.01)
(Continued)

(52) U.S. Cl.
CPC ..... *H01R 24/005* (2013.01); *H01R 13/514* (2013.01); *H01R 13/639* (2013.01); *H01R 13/6315* (2013.01); *H01R 13/70* (2013.01)

(58) Field of Classification Search
CPC ... H01R 13/44; H01R 13/4538; H01R 24/005
(Continued)

(56) References Cited

U.S. PATENT DOCUMENTS 5,788,522 A * 8/1998 Kameyama ..... H01R 13/627 439/248
2006/0216980 A1 9/2006 Lewis
(Continued)

FOREIGN PATENT DOCUMENTS

DE 100 12 324 A1 10/2001

OTHER PUBLICATIONS

German Office Action, dated Apr. 28, 2016, for German Application No. 10 2015 011 494.8, 5 pages (no English translation provided).
(Continued)

*Primary Examiner* — Tulsidas C Patel
*Assistant Examiner* — Marcus E Harcum
(74) *Attorney, Agent, or Firm* — Seed IP Law Group LLP

(57) ABSTRACT

A plug-in system comprises a docking device which has a first plug-in module that is bidirectionally displaceable parallel to a connection direction and at least one spring arm, as well as a second plug-in module which can be connected to the first plug-in module in the connection direction. The plug-in system can be transferred between a separated state, in which the second plug-in module and the docking device are separated from each other and the spring arm limits a displacement of the first plug-in module at least in the connection direction, and a docked state in which the first plug-in module and the second plug-in module are connected to each other and the first plug-in module assumes a position which can be reached by a displacement of the first plug-in module which exceeds the limit in the connection direction.

16 Claims, 7 Drawing Sheets

(51) Int. Cl.
*H01R 13/631* (2006.01)
*H01R 13/639* (2006.01)
*H01R 13/70* (2006.01)

(58) Field of Classification Search
USPC ..... 439/131
See application file for complete search history.

(56) References Cited

U.S. PATENT DOCUMENTS

2007/0093093 A1* 4/2007 Lev ..... H01R 13/4538
439/131
2014/0004728 A1* 1/2014 Zhou ..... H01R 13/635
439/131
2014/0004729 A1* 1/2014 Wong ..... G06F 1/1632
439/131
2014/0120751 A1* 5/2014 Senatori ..... G06F 1/1656
439/131
2016/0181717 A1* 6/2016 Kuo ..... H01R 13/44
439/131

OTHER PUBLICATIONS

International Search Report and Written Opinion, dated Dec. 5, 2016, for International Application No. PCT/DE2016/100411, 11 pages (with English translation of Search Report).

* cited by examiner

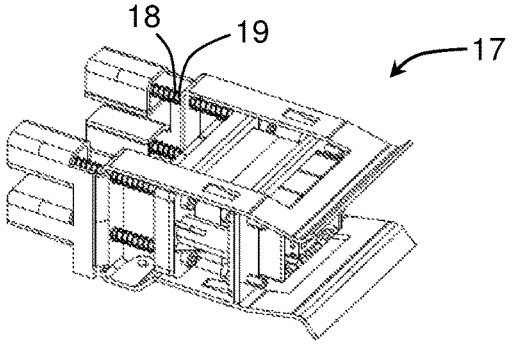
Fig. 3
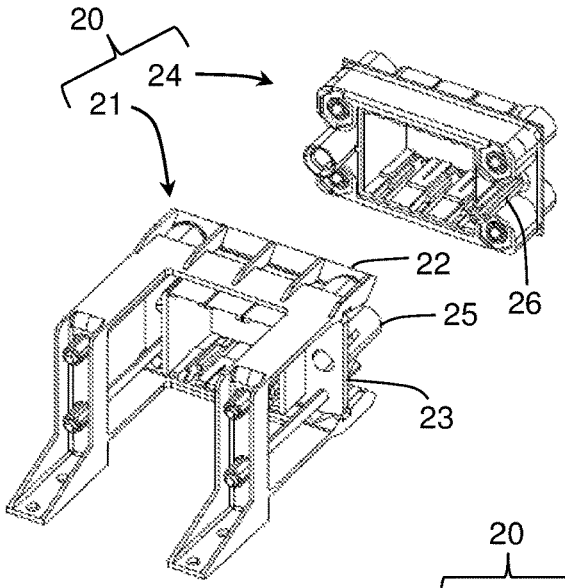
Fig. 4a)
Fig. 4b)
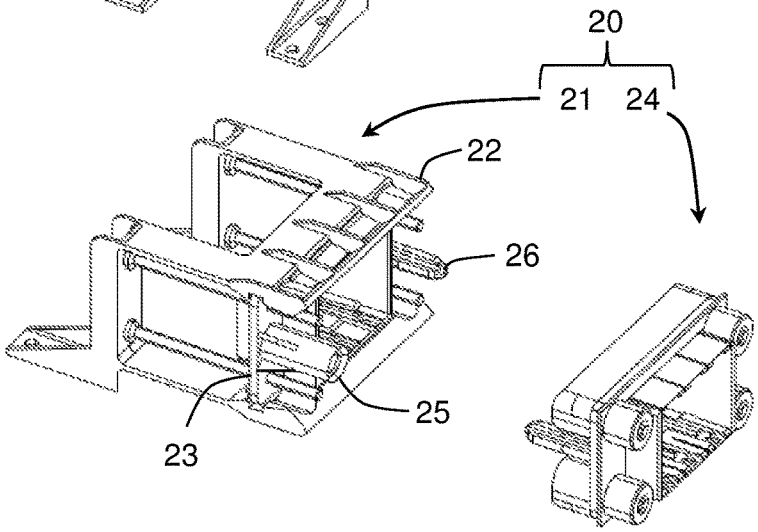

PLUG-IN SYSTEM AND APPARATUS COMPRISING A PLUG-IN SYSTEM

BACKGROUND

Technical Field

The present disclosure relates to a plug-in system, which has a first plug-in module, and has a second plug-in module that can be connected to the first plug-in module in a connection direction, wherein the first plug-in module and the second plug-in module each have at least one line end portion of a data transmission line that are in contact with each other after the first plug-in module and the second plug-in module are connected. The disclosure additionally relates to a facility having such a plug-in system.

Description of the Related Art

Cubicles, switchgear cabinets, racks or shelves having current contacts and displaceable elements such as withdrawable units or drawers have a wide range of practical applications. When such facilities are in an operationally ready state, their displaceable elements assume an end position in which they are inserted in a receiver, and a contact is established between the current contacts and the displaceable elements. Frequently, before the displaceable elements are brought into this end position, data polling is effected, for which purpose a data transmission connection is established to the displaceable element, by means of which connection, for example, the proper functioning of the current contacts or the correct position of the displaceable element is checked, in order to ensure correct contacting of the displaceable element to the current contacts in the end position.

Known for this purpose is the use of plug-in systems having two plug-in modules, of which a first plug-in module is disposed on a housing or a frame or a structural element of the facility, and a second plug-in module is disposed on the displaceable element. Since the data transmission connection must be established before the displaceable element is fully inserted into the housing or into the frame of the facility, comparatively long metallic line contacts must be used for the plug-in modules, in order that a distance that exists between the two plug-in module can be bridged and in order to obtain a satisfactory contact area overlap. Owing to their special materials and surface coatings, line contacts on the one hand are relatively expensive and on the other hand are susceptible to wear. With frequent connecting and disconnecting of the plug-in modules, therefore, the line contacts quite rapidly become worn and have to be replaced, with the result that the operating costs of such facilities are increased.

It is known to replace plug-in systems by application-specific structural measures. However, such measures are mostly elaborate, and are therefore likewise expensive.

BRIEF SUMMARY

Embodiments of the present invention provide a plug-in system, having line contacts that are as short as possible, that enables a reliable contact for data transmission to be established even before its components are finally connected.

According to embodiments of the present invention, the plug-in system has a docking device, having a first plug-in module that is bidirectionally displaceable parallel to a connection direction and having at least one spring arm, wherein the plug-in system can be changed over between a separated state, in which the second plug-in module and the docking device are separated from each other and the spring arm delimits a displacement of the first plug-in module at least in the connection direction, and a docked state, in which the first plug-in module and the second plug-in module are connected to each other and the first plug-in module assumes a position that can be attained by a displacement of the first plug-in module that exceeds the delimitation in the connection direction, wherein, when the plug-in system is being changed over from the separated state to the docked state, the second plug-in module elastically deforms the spring arm, as a result of which the spring arm releases the first plug-in module for a displacement beyond the delimitation in the connection direction. Thus, in the case of the plug-in system of embodiments of the present invention, instead of long line contacts a displaceable first plug-in module is provided, which, when the plug-in system is in the docked state, is displaced further in the connection direction than when the plug-in system is in the separated state. It is thereby made possible for the first plug-in module to be connected to the second plug-in module even before the docked state is attained, rendering long line contacts superfluous. In addition, the plug-in system according to embodiments of the present invention are distinguished by a robust and simple structural design, this likewise having the effect of reducing costs and, furthermore, enhancing the reliability of both the docking of the second plug-in module to the docking device and the connection of the second plug-in module to the first plug-in module.

Quite generally, the docking device may have a frame or a housing. For example, the spring arm may form a part of the frame or of the housing. Preferably, the spring arm overlaps a path segment on which the first plug-in module is bidirectionally displaceable. The frame in this case may be designed to guide the first plug-in module, when the latter is being displaced, in and contrary to the connection direction. The frame of the docking device may thus have two spring arms, which are substantially parallel to the connection direction and project contrary to the connection direction, and which, on two opposite sides of the first plug-in module, are disposed so as to overlap a path segment on which the first plug-in module is bidirectionally displaceable. In the connection direction, behind the first plug-in module, these spring arms may be connected to each other.

For the purpose of delimiting the displacement of the first plug-in module in the connection direction, the spring arm may have, for example, a projection or stop which, when the plug-in system is in the separated state, blocks the path of the first plug-in module in the connection direction, and which, as the plug-in system is being changed over from the separated state to the docked state, upon deformation of the spring arm, is cleared out of the path of the first plug-in module. The first plug-in system may also have a projection or stop against which the projection or stop of the spring arm strikes when the plug-in system is in the separated state. The frame and the spring arm may be made wholly or partly from metal or plastic. For example, in the case of a spring arm formed from a strip of sheet metal or of plastic, the projection or stop of the spring arm may be realized as a lug that is cut out of the strip and bent in the direction of the first plug-in module. In particular, at least the spring arm may be made of an elastic material. Moreover, the frame or the housing of the docking device may be realized so as to form a single piece with the spring arm.

Insofar as the docking device has a frame or a housing, when the plug-in system is in the docked state further displacement of the first plug-in module in the connection direction can be prevented in that the first plug-in module strikes against the frame or a housing wall. In the case of a particularly advantageous embodiment of the invention, in the docked state the spring arm blocks a displacement of the first plug-in module and/or of the second plug-in module in the connection direction. For this purpose, the second plug-in module also may have a projection or stop, against which the projection or stop of the spring arm strikes when the plug-in system is in the docked state, and thereby delimits or prevents further displacement of the second plug-in module and, with the latter, also of the first plug-in module connected to the second plug-in module, in the connection direction. In the case of this embodiment, when the plug-in system is in the docked state the first plug-in module can assume a position in which a usable clearance remains in the connection direction, behind the first plug-in module.

Advantageously, when the plug-in system is in the separated state, the spring arm delimits a displacement of the first plug-in module contrary to the connection direction. This may be achieved, for example, in that the spring arm has a correspondingly bent portion that, when the plug-in system is in the separated state, blocks movement of the first plug-in module in a direction contrary to the connection direction. It is thereby ensured, in a simple manner, that the first plug-in module cannot be unintentionally separated from the rest of the components of the docking device by, for example, falling out of a frame or housing of the docking device, contrary to the connection direction.

Possible in principle are embodiments of the plug-in system according to the invention in which a connection of the first plug-in module and second plug-in module is effected before the first plug-in module is released by the spring arm and a displacement of the same is effected in the connection direction. Particularly preferably, however, the plug-in system is designed to assume at least one intermediate state, between the separated state and the docked state, in which the first plug-in module and the second plug-in module are connected to each other, and the first plug-in module is displaced farther, relative to its position when the plug-in system is in the separated state, and is displaced less far in the connection direction relative to its position when the plug-in system is in the docked state. Such an intermediate state of the plug-in system, which is between the separated state and the docked state of the plug-in system, enhances the reliability of the data polling, since the partial docking of the second plug-in module to the docking device reduces the risk of the second plug-in module becoming tilted. The intermediate state in this case may be characterized by a predefined position of the first plug-in module and of the second plug-in module, or by a multiplicity of positions within a predefined path segment of the first and second plug-in module, which may succeed one another directly, but also continuously.

A facility according to an embodiment of the present invention may have a housing or a frame in which the receiver for the displaceable element is provided. The displaceable element may be, for example, a drawer or a withdrawable compartment. Insofar as the docking device is disposed on the displaceable element, the second plug-in module is disposed, inside the receiver, at a corresponding point, for example on a structural element of the facility, frame or housing. If, conversely, the second plug-in module is disposed on the displaceable element, then the docking device is disposed at a corresponding point on the receiver.

Preferably, the facility according to an embodiment the invention has at least one current contact that can be contacted to the displaceable element, wherein the displaceable element contacts the current contact when the plug-in module is in the docked state. This current contact is advantageously designed for higher currents than the line end portions for data transmission of the first and second plug-in module. The said current contact may also be designed, in particular, as a high-current contact.

BRIEF DESCRIPTION OF THE SEVERAL VIEWS OF THE DRAWINGS

The invention is explained in greater detail in the following on the basis of exemplary embodiments, with reference to drawings. There are shown:

FIG. 3 shows a second illustrated embodiment of a plug-in system according to the invention;

FIG. 4*a*) shows a third illustrated embodiment of a plug-in system according to the invention, in a first three-dimensional representation;

FIG. 4*b*) shows the third embodiment of a plug-in system according to the invention, in a second three-dimensional representation;

DETAILED DESCRIPTION

Figure 1A:
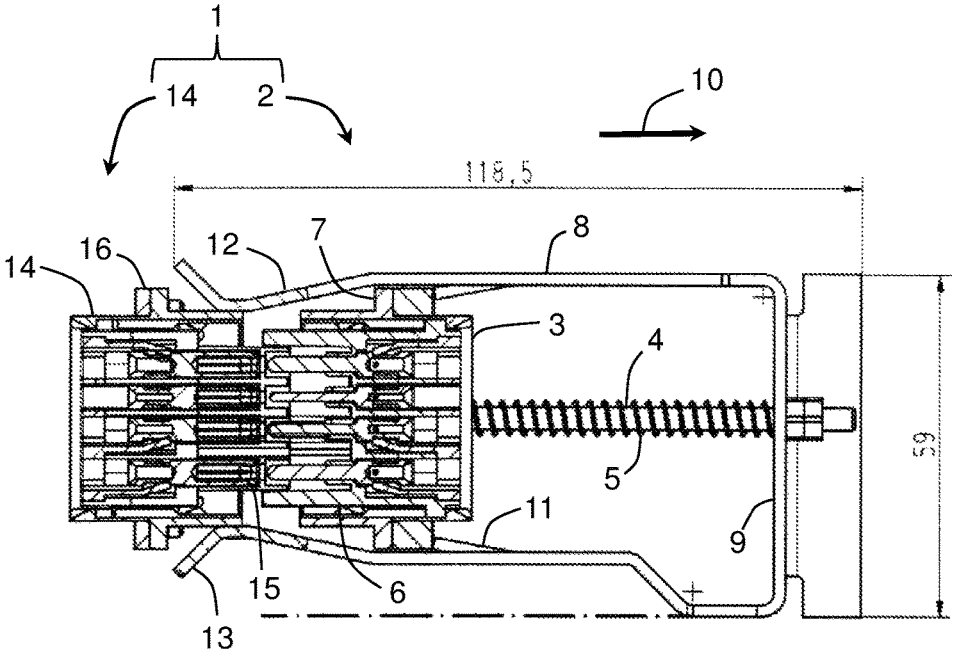
FIG. 1*a*) shows a plug-in system being pre-positioned for being changed over from a separated to a docked state.
Figure 2:
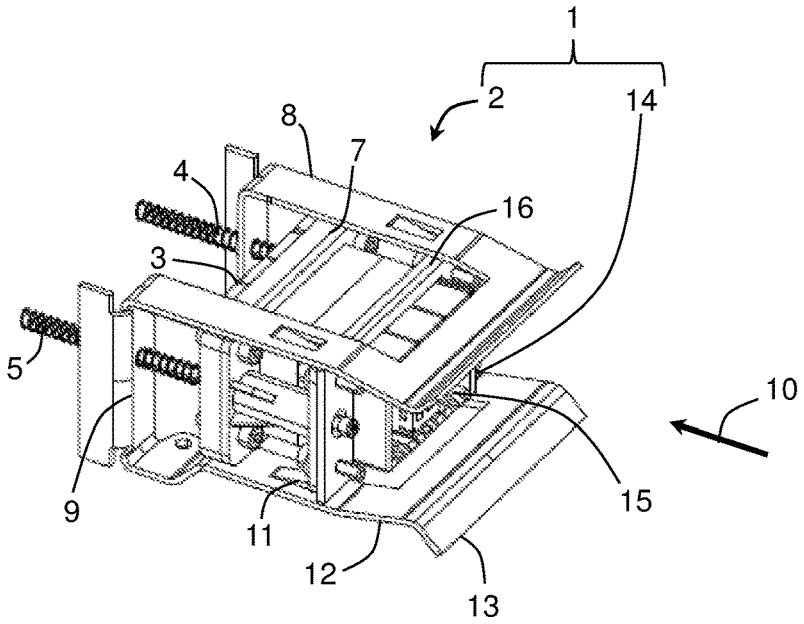
FIG. 2 shows the plug-in system in the docked state, in a three-dimensional representation.

Represented in FIGS. 1*a*)-*g*) is a connection operation for a plug-in system 1 according to one illustrated embodiment the invention, which is being changed over from a separated state to a docked state. FIG. 2 shows a three-dimensional representation of the plug-in system 1 in the docked state. Dimensions indicated in the figures are in millimeters in each case.

The plug-in system 1 of FIGS. 1*a*)-*g*) and 2 has a docking device 2, having a first plug-in module 3, which is realized so as to be bidirectionally displaceable, guided by two straight, parallel guide pins 4. The guide pins 4 are surrounded by helical springs 5. The first plug-in module 3 is substantially a square body, having a plurality of line end portions 6 that, as plug connector contacts, are open toward a side of the first plug-in module 3 that faces away from the helical springs 5. Respective projections 7, extending transversely in relation to the guide pins 4, are realized on two mutually opposite sides of the first plug-in module 3 that are parallel to the guide pins 4.

Besides the first plug-in module 3, the docking device 2 has two elongate elastic spring arms 8 made of metal, which overlap the first plug-in module 3 at the two sides having the projections 7, and which are substantially U-shaped and closed on a side that faces away from the helical springs 5. On a side of the first plug-in module 3 that faces toward the helical springs 5, the spring arms 8 are connected to each other by connection portions 9 oriented orthogonally in relation to the guide pins 5. In FIG. 1*a*, the helical springs 5 bear with one of their ends against the first plug-in module 3 and with another of their ends against the connection portions 9, and are thereby compressed when the first plug-in module 3 is displaced in a connection direction 10, indicated as an arrow, such that they exert a restoring force, contrary to the connection direction 10, upon the first plug-in module 3. In addition, the spring arms 8 have lugs 11 that are bent in toward the first plug-in module 3. In the situation shown in FIG. 1*a*), the projections 7 of the first plug-in module 3 strike against the lugs 11, as a result of which a movement of the first plug-in module 3 in the connection direction 10 is delimited by the lugs 11 to the position of the first plug-in module 3 shown in FIG. 1*a*. End portions of the spring arms 8 that face away from the connection portions 9 have a portion 12, which portions converge toward each other contrary to the connection direction 10 and, adjoining that portion, a portion 13, which portions diverge from each other contrary to the connection direction 10. Owing to the portions 12 that converge towards each other, a movement of the first plug-in module 3 contrary to the connection direction 10 is also delimited, preventing the first plug-in module 3 from becoming detached from the interconnected system constituted by the spring arms 8 and guide pins 5, and preventing the docking device 2 from falling apart. On the other hand, the portions 13 that diverge from each other act, in the connection direction 10, in the manner of a funnel.

In addition to the docking device 2, the plug-in system 1 has a second plug-in module 14, which can be connected to the first plug-in module 3. Like the first plug-in module 3, the second plug-in module 14 is also substantially square in form. A plurality of elongate line end portions 15 of the second plug-in module 14 are provided as counter-plug connector contacts to the line end portions 6 or plug connector contacts of the first plug-in module 3, and are open toward a side of the second plug-in module 14 that faces toward the first plug-in module 3. Two mutually opposite sides of the second plug-in module 14 that are orthogonal to that side are provided with projections 16 that extend transversely in relation to the line end portions 15.

In FIG. 1*a*), the plug-in system 1 is shown being prepositioned for being changed over from the separated to the docked state. The docking device 2 in this case normally lies on a surface or mounting plane, which in FIG. 1 is represented by a dot-dash line. The second plug-in module 14 is positioned level with the first plug-in module 3, the openings of the line end portions 15 of the second plug-in module 14 facing toward the line end portions 6 of the first plug-in module 3. The portions 13 of the spring arm 8 that act in the manner of a funnel prove to be of assistance in bringing the second plug-in module 14 into this position. However, the first plug-in module 3 and the second plug-in module 14 are still separate from each other. As can be seen in FIG. 1*a*), the spring arms 8 and the second plug-in module 14 are dimensioned in such a manner that the spring arms 8, at those points at which their portions 12 that converge toward each other, contrary to the connection direction 10, adjoin the portions 13 that diverge from each other, contrary to the connection direction 10, corresponding to the narrowest point between the spring arms 8 in FIG. 1*a*), bear against the sides of the first plug-in module 14 provided with the projections 16. In FIG. 1*a*), the portions 13 of the spring arms 8 that diverge from each other, contrary to the connection direction 10, are spaced apart from the projections 16.

Figure 1B:
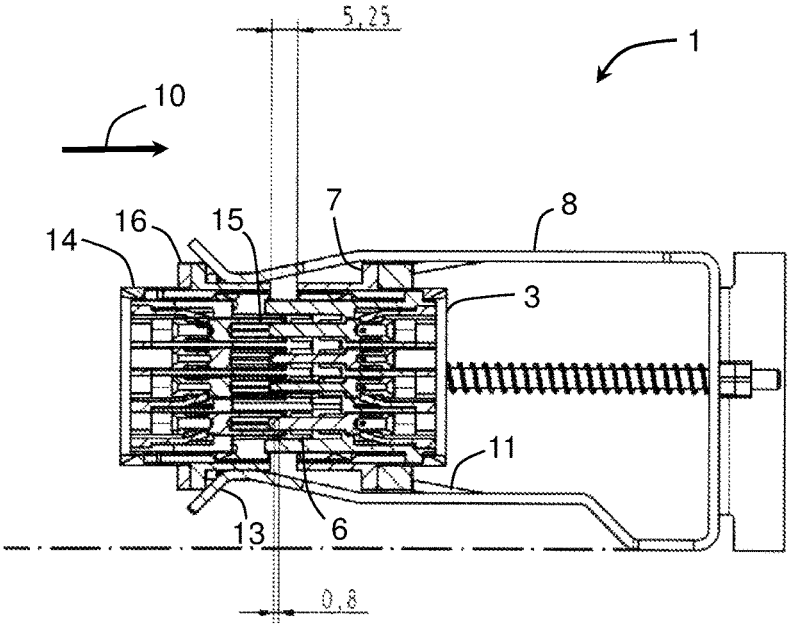
FIG. 1*b*) shows the plug-in system during the changeover, projections of a second plug-in module being in contact with spring arms.

FIG. 1*b*) shows the plug-in system 1 following displacement of the second plug-in module 14, in the connection direction 10, into a position in which the projections 16 come into contact with the portions 13 of the spring arms 8 that diverge from each other, contrary to the connection direction 10. As the second plug-in module 14 is being displaced, displacement of the first plug-in module 3 in the connection direction 10 is prevented by the lugs 11, the projections 7 of the first plug-in module 3 striking against the latter. A distance between the first plug-in module 3 and the second plug-in module 14, or a distance between mutually facing surfaces thereof, is 5.25 mm, according to the illustrated embodiment. On the other hand, there is already a contact area overlap of 0.8 mm between the line end portions 15 of the second plug-in module 14 and the line end portions 6 of the first plug-in module 3.

Figure 1C:
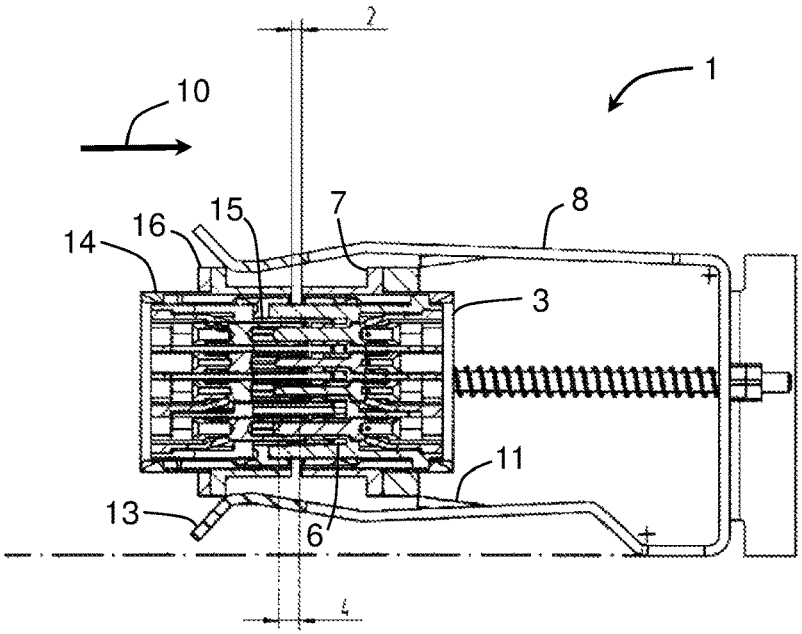
FIG. 1*c*) shows the plug-in system during the changeover, with unlocked first plug-in module.

If the second plug-in module 14 is pressed farther in the connection direction 10, the projections 16 that are in contact with the portions 13 of the spring arms 8 that diverge from each other, contrary to the connection direction 10, begin to press against these portions 13, and thereby begin to bend the elastic spring arms 8 away from the second plug-in module 14. The farther the second plug-in module 14 is displaced in the connection direction 10, the more the spring arms 8 become spread, until the lugs 11 are also moved away from the projections 7 of the first plug-in module 3 and the contact between the projections 7 and the lugs 11 becomes undone. Upon the undoing of the contact between the projections 7 and the lugs 11, the first plug-in module 3 is no longer prevented from moving in the connection direction 10, i.e., the spring arms 8 release the first plug-in module 3 for displacement in the connection direction 10, beyond the original delimitation resulting from the contact of the projections 7 with the lugs 11. In other words, the first plug-in module 3 is unlocked for displacement in the connection direction 10. This is represented in FIG. 1*c*) for a situation in which the first plug-in module 3 and the second plug-in module 14 are still 2 mm apart from each other, and the contact area overlap between the line end portions 15 of the second plug-in module 14 and the line end portions 6 of the first plug-in module 3 is now 4 mm, according to the illustrated embodiment.

Figure 1D:
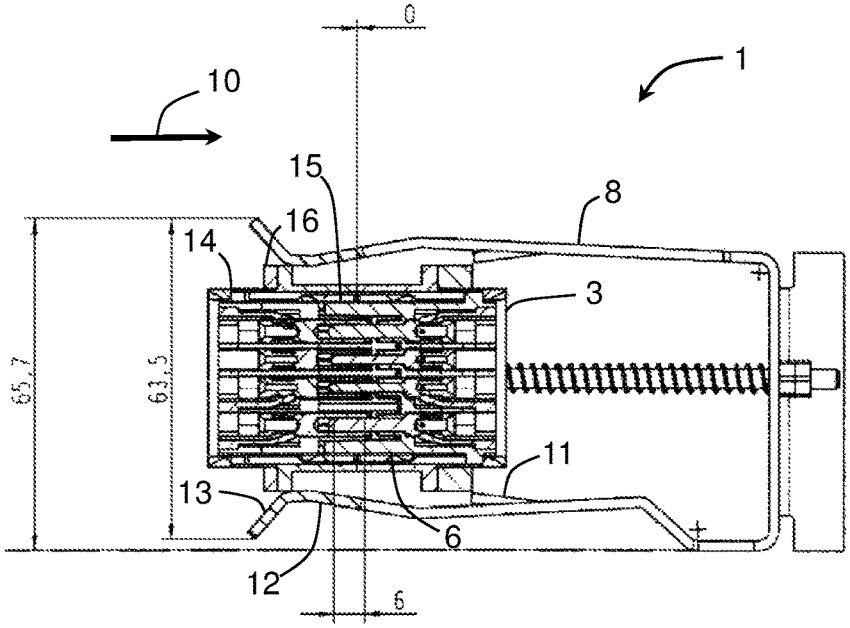
FIG. 1*d*) shows the plug-in system during the changeover, the first plug-in module and the second plug-in module having been connected to each other.

When the first plug-in module 3 and the second plug-in module 14 finally meet together and the distance between them vanishes, or becomes 0 mm, the contact area overlap between the line end portions 15 of the second plug-in module 14 and the line end portions 6 of the first plug-in module 3 attains the maximum value of 6 mm, according to the illustrated embodiment. This is shown in FIG. 1*d*). The spring arms 8 are now maximally spread, with a spread width of 63.5 mm, and the maximum height of the plug-in system 1 with respect to the mounting plane is 65.7 mm. At the connection points between the portions 12 that converge toward each other, contrary to the connection direction 10, and the portions 13 that diverge from each other, contrary to the connection direction 10, the spring arms 8 begin to lie on the projections 16 of the second plug-in module 14, while the first plug-in module 3 remains released or unlocked from the lugs 11 in the connection direction 10.

Figure 1E:
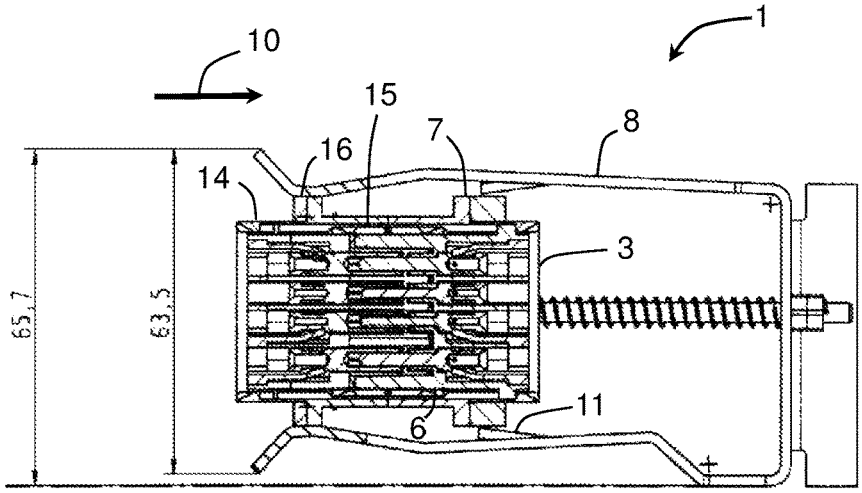
FIG. 1*e*) shows the plug-in system during the changeover, in an intermediate position.

As the second plug-in module 14 is displaced farther in the connection direction 10, the spring arms 8, as shown in FIG. 1*e*), slide on the projections 16 of the second plug-in module 14, while the first plug-in module 3 is likewise displaced in the connection direction 10 and the lugs 11 slide on the projections 7 of the first plug-in module 3. The spread width of the spring arms 8 in this case remains constant, at 63.5 mm, and also the maximum height of the plug-in system 1 with respect to the mounting plane remains unchanged, at 65.7 mm. In the situation represented in FIG. 1*e*), data can be transmitted via the line end portions 15 of the second plug-in module 14 and the line end portions 6 of the first plug-in module 3, which are in contact with each other. Thus, in this situation, for example, preliminary data polling can be effected, in order to change the plug-in module over to the final, docked state, provided that this data polling produces a positive result.

Figure 1F:
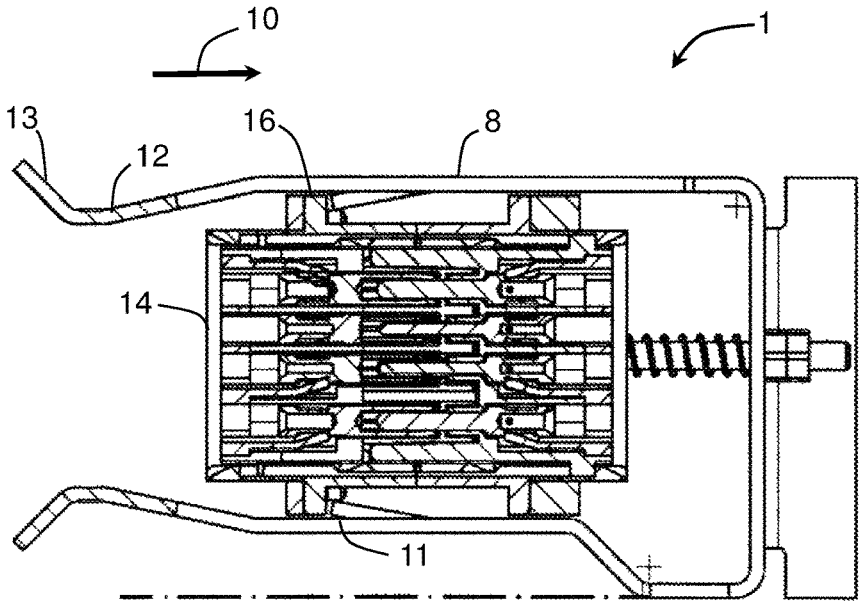
FIG. 1*f*) shows the plug-in system in the docked state.

Finally, in FIG. 1*f*), the plug-in system 1 attains its docked state, to the extent that the second plug-in module 14 is pressed farther in the connection direction 10. After the projections 16 of the second plug-in module 14 have passed that point of the spring arms 8 at which their portions 12 and 13 meet, the spring arms 8, owing to their elastic properties, move back into their original, unbent state. As a result of this, the projections 16 of the second plug-in module 14 now come into contact with the lugs 11, as a result of which a further displacement of the second plug-in module 14, and consequently also of the first plug-in module 3 connected to the second plug-in module 14, in the connection direction 10 is delimited.

Figure 1G:
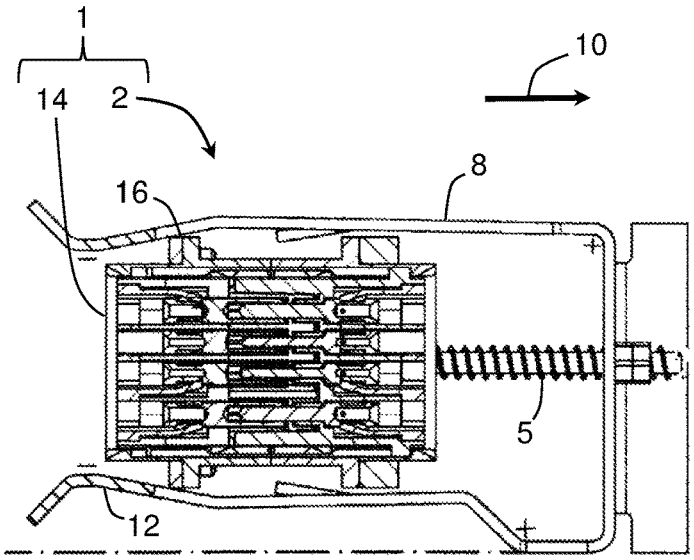
FIG. 1*g*) shows the plug-in system during the changeover from the docked state to the separated state.

In order to change the plug-in system 1 over from the docked state, shown in FIG. 1*f*), back to the separated state, the second plug-in module 14 is moved contrary to the connection direction 10, as shown in FIG. 1*g*). In the course of this movement, the projections 16 of the second plug-in module 14 come into contact with the portions 12 of the spring arms 8 that converge toward each other in the connection direction 10, and exert a force upon these portions, resulting in spreading of the spring arms 8. In this, the restoring force by the helical springs 5, which have been compressed while the plug-in system 1 is changed over from the separated state to the docked state, provide assistance. As the changeover of the plug-in system 1 to the separated state progresses, the situations represented in FIGS. 1*a*) to 1*e*) pertain in reverse sequence, until the second plug-in module 14 is finally spaced apart from the docking device 2.

FIG. 3 shows a plug-in system 17, which is similar to the plug-in system 1 and which differs from the plug-in system 1 substantially in the number of guide pins and helical springs. Whereas two parallel guide pins 5 are provided in the case of the plug-in system 1, the plug-in system 17 of FIG. 3 has four guide pins 18, which are parallel to each other, and four helical springs 19.

Figure 5:
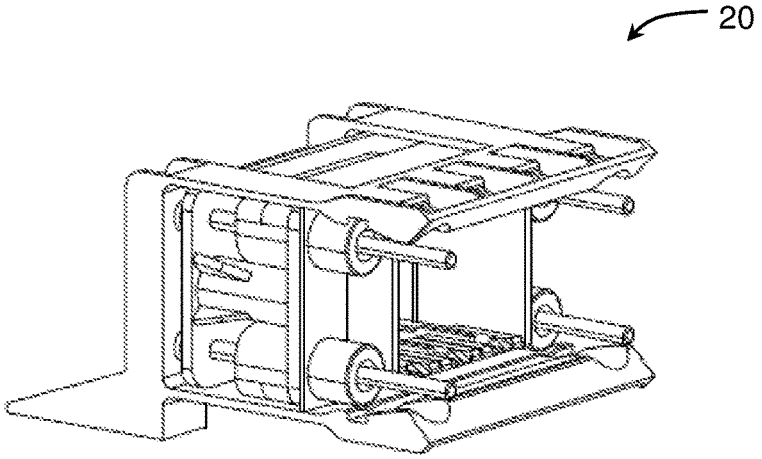
FIG. 5 shows the third embodiment of a plug-in system according to the invention, in a docked state.

A further plug-in system 20 according to an example embodiment of the invention is shown in FIGS. 4*a*) and 4*b*), in each case in a three-dimensional representation, from two differing viewing directions, in the separated state. FIG. 5, on the other hand, shows the docked state of the plug-in system 20. In order to enhance clarity in FIGS. 4*a*), 4*b*) and 5, the line end portions have not been represented. Like the plug-in systems 1 and 17, the plug-in system 20 has a docking device 21, having spring arms 22 and a first plug-in module 23, as well as a second plug-in module 24. Unlike the plug-in systems 1 and 17, however, in the case of the plug-in system 20 the spring arms 22 of the docking device 21 are made from plastic. Realized to improve the connectability of the first plug-in module 23 and second plug-in module 24 there are two plug-in connection structures, which each comprise a bushing 25 and an associated stud 25, which is received in the bushing 25 when the first plug-in module 23 and the second plug-in module 24 are connected. Of the pair constituted by a bushing 25 and an associated stud 26, in each case either the bushing 25 or the stud 26 is realized on the first plug-in module 23 or on the second plug-in module 24.

All described plug-in systems are suitable, in particular, for use in switchgear cabinets or switchgear racks.

Figure 6:
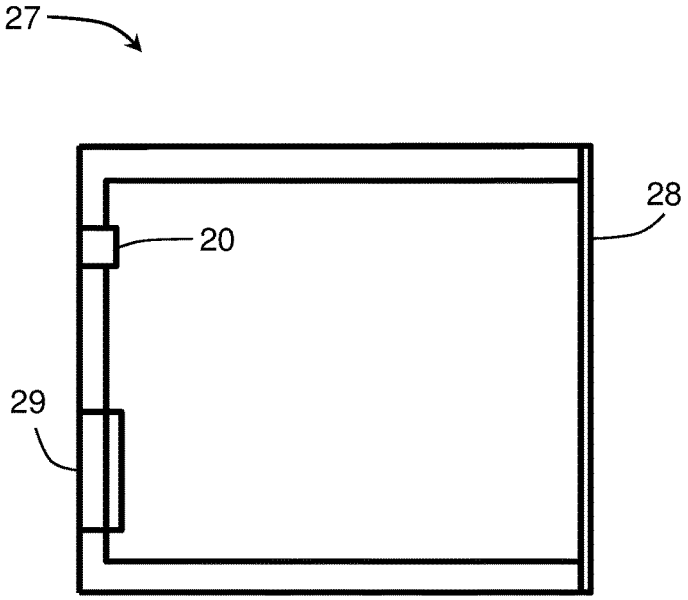
FIG. 6 shows a rack system having the third embodiment of a plug-in system according to the invention.

For this purpose FIG. 6 shows, exemplarily, the plug-in system 20, in the docked state, which is built-in in a switchgear rack 27 having displaceable withdrawable compartments 28. In this case, the docking device 21 of the plug-in system 20 is disposed in a receiver for the withdrawable compartment 28, and the second plug-in module 24 is connected to the withdrawable compartment 28 in such a manner that the plug-in system 20 can be changed over between the separated state and the docked state by displacement of the withdrawable compartment 28. If the withdrawable compartment 28 is drawn out of the switchgear rack 27, the plug-in system 20 is changed over from the docked state, shown in FIG. 6, to the separated state. If, conversely, the withdrawable compartment 28 is pushed into the switchgear rack 27, the plug-in system 20 is changed over from the separated state to the docked state.

If the withdrawable compartment 28 is pushed so far into the switchgear rack 27 that the plug-in system 20 assumes the docked state, the withdrawable compartment 28 is connected to high-current contacts 29 that are provided on the switchgear rack 27. However, before the plug-in system 20 assumes the docked state and the connection of the withdrawable compartment 28 to the high-current contacts 29 is effected, it is possible, as described above in connection with FIG. 1*e*), to perform data polling by way of the plug-in system 20 and to ascertain whether possibly there is damage at the high-current contacts 29. It is only after it is established, following this polling, that contacting of the high-current contacts 29 is possible without difficulty, that the withdrawable compartment 28 is finally inserted into the switchgear rack 27 and the plug-in system 20 is changed over to the docked state.

Figure 7A:
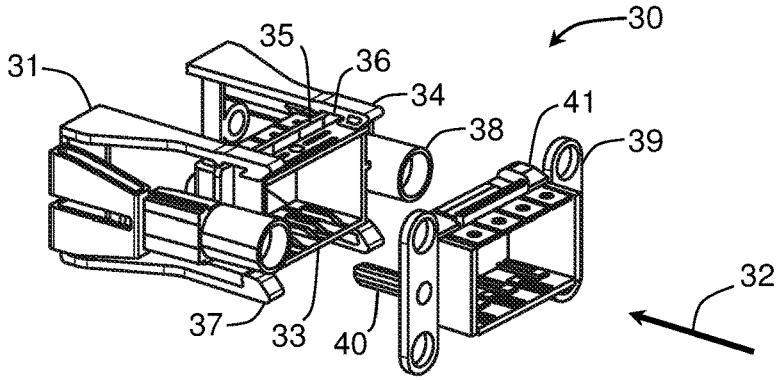
FIG. 7*a*) shows a fourth illustrated embodiment of a plug-in system according to the invention, in the separated state.

FIGS. 7*a*)-*c*) show the operation of connecting a plug-in system 30 according to a further embodiment. To enhance clarity, data transmission lines have not been represented in FIGS. 7*a*)-*c*).

A docking device 31 of the plug-in system 30 has a substantially rectangular first plug-in module 33 that is bidirectionally displaceable parallel to a connection direction 32, indicated by an arrow in FIG. 7*a*), and two elastic spring arms 34, which are parallel both to each other and to the connection direction 32. Realized on one of the two long sides of the first plug-in module 33 facing toward the spring arms 34 there is a strip 35, which extends, transversely in relation to the connection direction 32, over the long side of the first plug-in module 33. Mutually opposite end portions of the strip 35 extending between the spring arms 34 are received in respective recesses 36 of the spring arms 34. The first plug-in module 33 bears, with its long side that faces away from the spring arms 34, against two support arms 37, which are parallel to each other and to the connection direction 32, and one of which respectively is opposite one of the two spring arms 34 and, on a side of the spring arm 34 that faces away from the recess 36, is connected to the spring arm 34. In addition, in each case a hollow bushing 38 bears against the two narrow sides of the docking device 31, the bushings 38 being oriented with their longitudinal axes parallel to the connection direction 32.

Owing to the spring arms 34, the support arms 37 and the bushings 38, the movement capability of the first plug-in module 33 transversely to the connection direction 32 is limited. For the first plug-in module 33, only movements parallel to the connection direction 32 are possible, which movements, however, are delimited in both directions by the strip 35 projecting into the recesses 36 of the spring arms 34.

The plug-in system 30 additionally has a second plug-in module 39, likewise substantially rectangular, which can be connected to the first plug-in module 33. A respective stud 40 is realized on each of the two narrow sides of the second plug-in module 39. In FIG. 7*a*), the studs 40 face toward the docking device 31, or toward the bushings 38 of the docking device 31. Furthermore, one of the long sides of the second plug-in module 39 has two projections 41, having beveled sides, at opposite ends that face toward the studs 40.

Figure 7B:
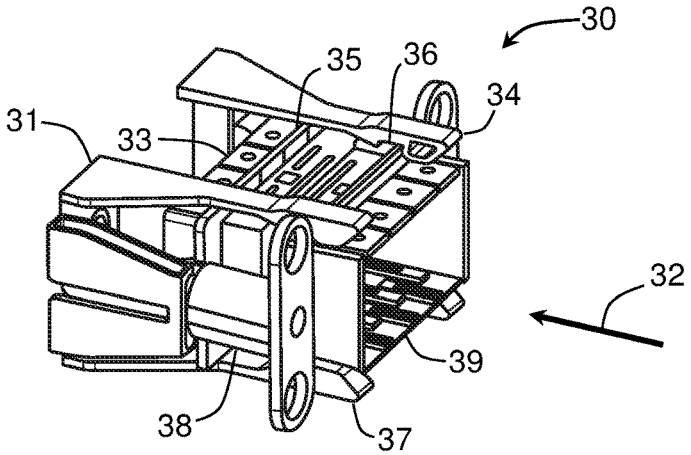
FIG. 7*b*) shows The plug-in system of FIG. 7*a*) during the changeover from the separated to the docked state.

Whereas, in FIG. 7*a*), the plug-in system 30 assumes a separated state, in which the second plug-in module 39 and the docking device 31, or the first plug-in module 33 thereof, are separate from each other, FIG. 8*b*) shows the plug-in system 30 during the changeover from the separated to the docked state. In order to go from the separated state shown in FIG. 7*a*) to the state shown in FIG. 7*b*), the second plug-in module 39 is moved, in the connection direction 32, onto the docking device 31, and consequently onto the first plug-in module 33 thereof. In this case, each of the studs 40 goes into a respective one of the bushings 38, while the projections 41 press, with their beveled sides, against the spring arms 34 and elastically deform the latter. Owing to the elastic deformation of the spring arm 34, the strip 35 of the first plug-in module 33 comes out of the recesses 36. The first plug-in module 33 is thus released for a movement or displacement, in the connection direction 32, into a position that, as shown in FIG. 7*b*), is displaced farther in the connection direction 32 as compared with the positions that can be attained by the first plug-in module 33 in FIG. 7*a*).

Figure 7C:
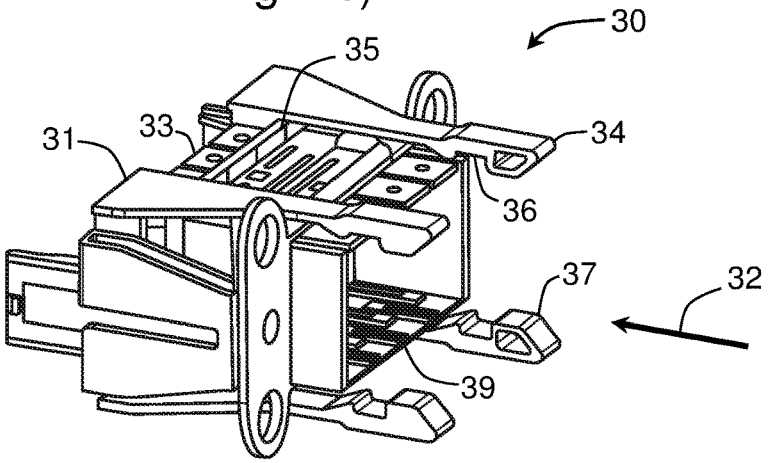
FIG. 7*c*) shows the plug-in system of FIGS. 7*a*) and 7*b*) in the docked state.

By further displacement of the first plug-in module 33 and the second plug-in module 39 in the connection direction 32, the plug-in system 30 finally attains the docked state shown in FIG. 7*c*). In this state, the first plug-in module 33 and the second plug-in module 39 are connected to each other, and the first plug-in module 33 assumes a position that it has attained by exceeding the delimitation of its movement capability in the connection direction 32 that is described in connection with FIG. 7*a*). A further displacement of the first plug-in module 33 in the connection direction 32 is prevented in this case by the connections of the spring arms 34 and the support arms 37, extending between the same, the first plug-in module 33 striking against these connections with its side that faces away from the second plug-in module 39.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A plug-in system, comprising:

a docking device having a first plug-in module that is bidirectionally displaceable parallel to a connection direction and having at least one spring arm; and a second plug-in module that can be connected to the first plug-in module in the connection direction, wherein the first plug-in module and the second plug-in module each have at least one line end portion of a data transmission line that are in contact with each other after the first plug-in module and the second plug-in module are connected, wherein the first plug-in module and the second plug-in module can be changed over between a separated state, in which the second plug-in module and the docking device are separated from each other and the spring arm delimits a displacement of the first plug-in module at least in the connection direction, and a docked state, in which the first plug-in module and the second plug-in module are connected to each other and the first plug-in module assumes a position that can be attained by a displacement of the first plug-in module that exceeds the delimitation in the connection direction, and wherein, when the plug-in system is being changed over from the separated state to the docked state, the second plug-in module moves in the connection direction and elastically deforms the spring arm while the first plug-in module initially remains stationary, as a result of which the spring arm releases the first plug-in module for a displacement beyond the delimitation in the connection direction.

2. The plug-in system as claimed in claim 1, in which, in the docked state, the spring arm blocks a displacement of the first plug-in module and/or of the second plug-in module in the connection direction.

3. The plug-in system as claimed in claim 1, in which, in the separated state, the spring arm delimits a displacement of the first plug-in module contrary to the connection direction.

4. The plug-in system as claimed in claim 1, which is designed to assume at least one intermediate state, between the separated state and the docked state, in which the first plug-in module and the second plug-in module are connected to each other, and the first plug-in module is displaced farther, relative to its position when the plug-in system is in the separated state, and is displaced less far in the connection direction relative to its position when the plug-in system is in the docked state.

5. A facility having a receiver, at least one element that is displaceable with respect to the receiver, and at least one plug-in system as claimed in claim 1, wherein either the docking device or the second plug-in module is connected to the displaceable element, and the plug-in system can be changed over between the separated state and the docked state by displacement of the element relative to the receiver.

6. The facility as claimed in claim 5, which has at least one current contact that can be contacted to the displaceable element, wherein the displaceable element contacts the current contact when the plug-in system is in the docked state.

7. The plug-in system as claimed in claim 1, wherein the spring arm is a cantilevered arm structure that extends in a direction opposite to the connection direction.

8. The plug-in system as claimed in claim 1, wherein the spring arm is an elongate structure with a free end.

9. The plug-in system as claimed in claim 1, wherein the spring arm is configured to flex away from the first plug-in module in response to direct contact by the second plug-in module when the plug-in system is being changed over from the separated state to the docked state.

10. The plug-in system as claimed in claim 1, wherein the docking device comprises opposing spring arms with diverging ends that are configured to insertably receive the second plug-in module in the connection direction.

11. A plug-in system, comprising:

a docking device having a first plug-in module that is bidirectionally displaceable parallel to a connection direction, and having opposing spring arms located on opposite sides of the first plug-in module; and a second plug-in module that can be connected to the first plug-in module in the connection direction, wherein the first plug-in module and the second plug-in module can be changed over between a separated state, in which the second plug-in module and the docking device are separated from each other and the opposing spring arms delimit a displacement of the first plug-in module in the connection direction, and a docked state, in which the first plug-in module and the second plug-in module are connected to each other and the first plug-in module assumes a position in which the first plug-in module exceeds the delimitation in the connection direction, and wherein, when the plug-in system is changed over from the separated state to the docked state, the second plug-in module moves in the connection direction and elastically deforms the opposing spring arms while the first plug-in module initially remains stationary, as a result of which the opposing spring arms release the first plug-in module for a displacement beyond the delimitation in the connection direction.

12. The plug-in system as claimed in claim 11, wherein the first plug-in module and the second plug-in module each have at least one line end portion of a data transmission line that are in contact with each other after the first plug-in module and the second plug-in module are connected.

13. The plug-in system as claimed in claim 11, wherein each of the opposing spring arms is a cantilevered arm structure that extends in a direction opposite to the connection direction.

14. The plug-in system as claimed in claim 11, wherein each of the opposing spring arms is an elongate structure with a free end.

15. The plug-in system as claimed in claim 11, wherein each of the opposing spring arms is configured to flex away from the first plug-in module in response to direct contact by the second plug-in module when the plug-in system is being changed over from the separated state to the docked state.

16. The plug-in system as claimed in claim 11, wherein the opposing spring arms have diverging ends that are configured to insertably receive the second plug-in module in the connection direction.

* * * * *